United States Patent [19]

Garlinghouse

[11] 3,962,892

[45] June 15, 1976

[54] MACHINE FOR CONTROLLED CONDITIONING OF LIQUIDS AND MIXTURES

[76] Inventor: Leslie H. Garlinghouse, 1585 Sierra Madre Villa, Pasadena, Calif. 91107

[22] Filed: May 29, 1973

[21] Appl. No.: 364,881

[52] U.S. Cl. ..... 68/23 R; 68/171; 134/118; 259/72

[51] Int. Cl.[2] ..... D06F 35/00

[58] Field of Search ..... 68/21, 23, 96, 147, 68/152, 171, 172, 173, 174, 23.6; 259/72; 134/117–121; 51/163

[56] References Cited

UNITED STATES PATENTS

| | | | |
|---|---|---|---|
| 2,265,516 | 12/1941 | Chayie | 68/171 X |
| 3,132,848 | 5/1964 | Garlinghouse | 68/96 X |

FOREIGN PATENTS OR APPLICATIONS

| | | | |
|---|---|---|---|
| 1,049,343 | 1/1959 | Germany | 68/96 |
| 75,697 | 8/1954 | Netherlands | 68/171 |

*Primary Examiner*—Philip R. Coe

[57] ABSTRACT

A container for liquids or solids carried in liquids has a rigid upper portion and a flexible lower portion. The rigid upper portion is mounted on and supported by a frame. The flexible lower portion is surrounded by a closed chamber which may, under certain circumstances also surround the rigid upper portion, whereby the contents of the container may be subjected to one or another of a variety of conditions such, for example, as being subjected to a vacuum or negative air pressure, a positive air pressure, a controlled atmosphere such as a selected gas, or a bath of treated liquid such as a washing solution. A wobble plate on the flexible lower portion is set in motion by an electric motor, the drive of which extends through the closed chamber of the flexible lower portion, thereby to agitate the contents under controlled conditions.

9 Claims, 5 Drawing Figures

43
33
47
46
40
22
36
30
37
35
30'
27'
38
62
61
32
29
18
19
2
31
34
47
46
27
60
16
33
40
43
21
20
39
45
41
42
58
59
28
25
55
57
10
43
56
56
53
54
52
26
17
51
12
13
50
14
15
11

MACHINE FOR CONTROLLED CONDITIONING OF LIQUIDS AND MIXTURES

The invention here under consideration involves an application of the wobble principle as applied to a flexible bag revealed in prior U.S. Pat. No. 3,132,848; and as applied to other machines as in U.S. Pat. Nos. 3,673,931; 2,917,979; 2,900,883; 2,856,133; and 2,854,222.

Although the wobble principle has been made use of in mixing such ingredients as concrete, such mixers are not always capable of being effectively and economically produced in small sizes such, for example, as might be useful in mixing laboratory samples or in another field in the washing of clothes. There is further, in sundry industrial processes, need for a washing machine capable of washing both hard and soft objects where the washing takes place in presence of liquid, liquid detergent, or other washing media, and for the washing of various materials, both hard objects and soft objects such as fabric. It is also necessary in some types of laboratory conditioning operations to wash or agitate a liquid in the presence of a vacuum, in the presence of a pressure above atmospheric, and perhaps in other assorted special environments.

It is therefore among the objects of the invention to provide a new and improved conditioner for liquid-like charges which is capable of effectively handling a wide variety of different types of liquids, mixtures, or liquids containing materials to be washed, which is compact in its arrangement and which can be operated by employment of no more than a modest amount of power.

Another object of the invention is to provide a new and improved conditioner for liquid-like charges wherein the container in which the charge is placed can be subjected to different environmental conditions while the conditioning is taking place and which is such that the environmental condition can be discontinued when the operation has been completed and the material ready for discharge.

Still another object of the invention is to provide a new and improved conditioner for liquid-like charges which, after the conditioning has been completed, can be spun in order to drive off moisture from the objects which have been subjected to conditioning.

Still another object of the invention is to provide a new and improved conditioner for liquid-like charges wherein the same source of power which is made use of in the initial conditioning, can also be made use of when it becomes desirable to remove the presence of moisture by centrifugal force.

Further included among the objects of the invention is to provide a new and improved conditioner for liquid-like charges wherein the conditioning operation can be housed entirely within the closed container until the entire conditioning operation has been completed, after which the container can be opened and the charge removed.

With these and other objects in view, the invention consists in the construction, arrangement, and combination of the various parts of the device, whereby the objects contemplated are attained, as hereinafter set forth, pointed out in the appended claims and illustrated in the accompanying drawings.

Figures 1, 2:
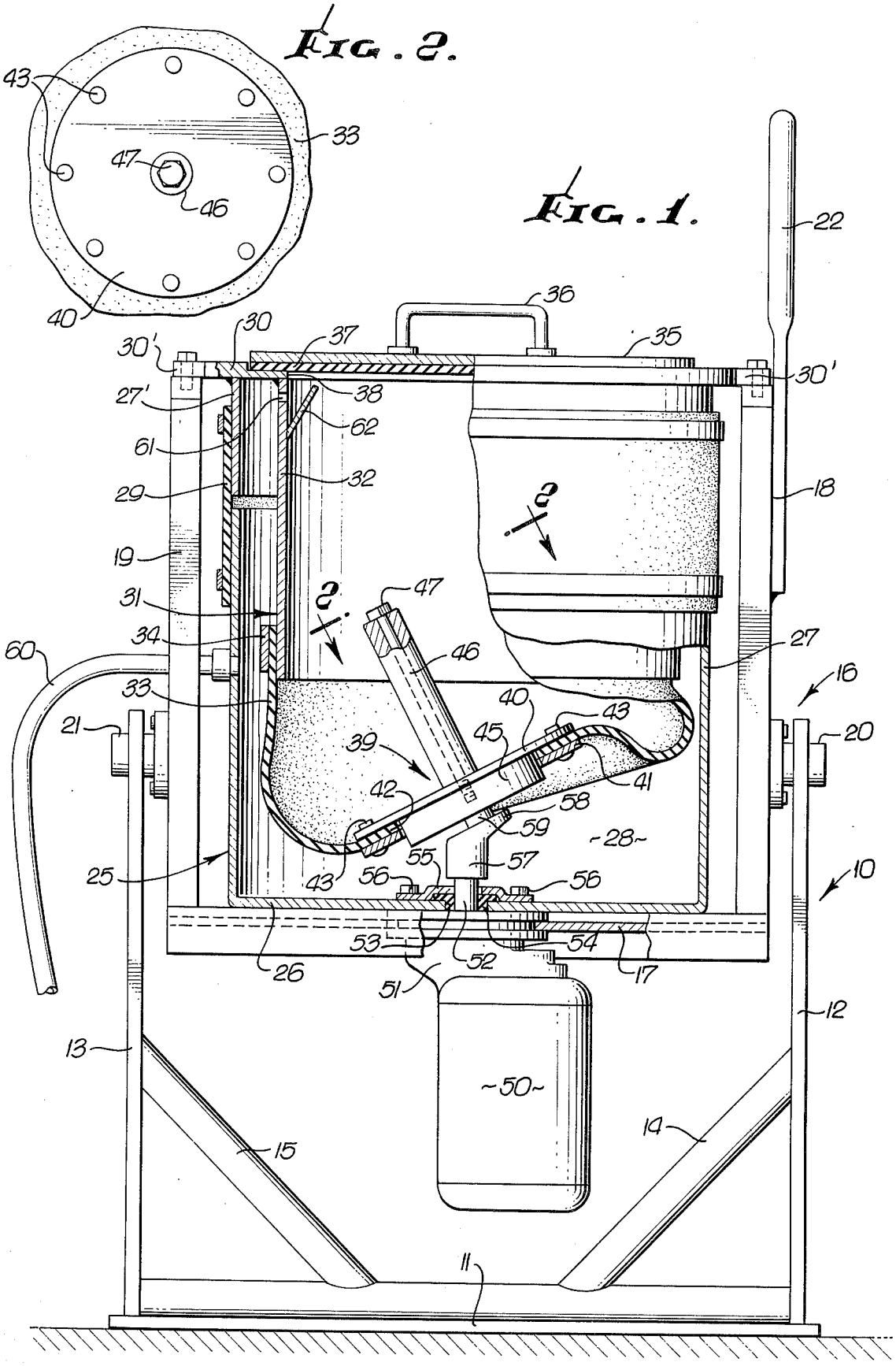
FIG. 1 is a longitudinal sectional view of one form of the device set up and ready for operation.
FIG. 2 is a cross sectional view on the line 2-2 of FIG. 1.

In an embodiment of the invention chosen for the purpose of illustration, there is shown in FIG. 1 a frame indicated generally by the reference character 10 consisting of a base 11 and upright legs 12 and 13 stiffened by braces 14 and 15 respectively. A yoke 16 consisting of a platform 17 and arms 18 and 19 is tiltably supported on the legs 12 and 13 by employment of a pivot connection 20 for the arm 18 and a pivot connection 21 for the arm 19. A handle 22 may be employed to tilt the yoke, and its load, when desired.

Supported by the yoke on the platform 17 is a housing 25 having a bottom wall 26 and a side wall 27, the side wall housing a chamber 28.

At the upper end of the housing 25 is a section 27′ joined to the housing 25 by a flexible band 29. The section 27′ is attached to an annular band 30 on which are lugs 30′ by which the section 27′ is supported at the tops of the arms 18 and 19. Also supported by the annular band 30 is an agitating container indicated generally by the reference character 31. Actually the container consists of two sections, namely, an upper rigid section 32 and a lower flexible section 33. The upper edge of the lower flexible section is anchored to the lower edge of the upper rigid section by a band 34. A cover 35 provided with a handle 36 has a seal 37 which makes a sealing connection with an upper rim 38 of the rigid section 32.

Fastened to the bottom of the lower flexible section is a wobble assembly indicated generally by the reference character 39. The wobble assembly consists of an inner plate 40 and an outer plate 41, outer perimeters of which secure between them an annular edge 42 of the lower flexible section by means of bolts 43.

An electric motor 50 is hung on the under side of the platform 17 and connected thereto by a casing 51 housing a gear reducer. A drive shaft 52 from the gear reducer extends upwardly through a hole 53 into the chamber 28. A liquid-tight packing 54 forms a rotating seal, being held down by a flange 55 secured by screws 56.

On the upper end of the drive shaft 52 is a fitting 57 providing an offset head 58. A tilted shaft 59 extending obliquely upwardly from the offset head is rotatably contained in a disc 45 which is anchored to the inner plate 40.

An agitator post 46 secured to the inner plate 40 by a bolt 47 extends into the exterior of the container 31 and moves with the wobble assembly 39.

By rotation of the fitting 57 and offset head 58 at a relatively slow speed achieved by employment of the gear reducer, an oscillating movement or wobble motion is imparted to the disc 45 and, accordingly, to the bottom of the lower flexible section 33 and its contents. Oscillation as described provides the agitation for the conditioning, cleaning or mixing of a charge in the container 31.

Where some special condition is desired as, for example, conditioning in the presence of a vacuum, there may be provided a vacuum line 60 in communication with the chamber 28 in the housing 25. A vent 61 protected by a baffle 62 is in communication with the interior of the container 31 to equalize pressure between the exterior and the interior of the flexible section 33 thereby permitting it to operate freely as long as the containers are being subjected to a vacuum condition. Conversely, a pressure condition could be maintained through the same line 60.

After conditioning of the charge within the container 31 by the wobble motion described, the charge can be discharged after first removing the cover 35 by manipulating the handle 22 in order to tilt the yoke and consequently the container 31 to a partially inverted position whereby the contents can be discharged. In this tilting operation the entire apparatus, namely, the yoke, the container 31, and motor 50 is tilted about the axis of rotation of the pivot connections, 20 and 21. By so balancing the assembly that the greater load is on the side occupied by the electric motor 50, when the container 31 is loaded with a charge, the yoke will always tend to assume the position of FIG. 1 which may be designated as upright position with the cover 35 at the top.

Figure 3:
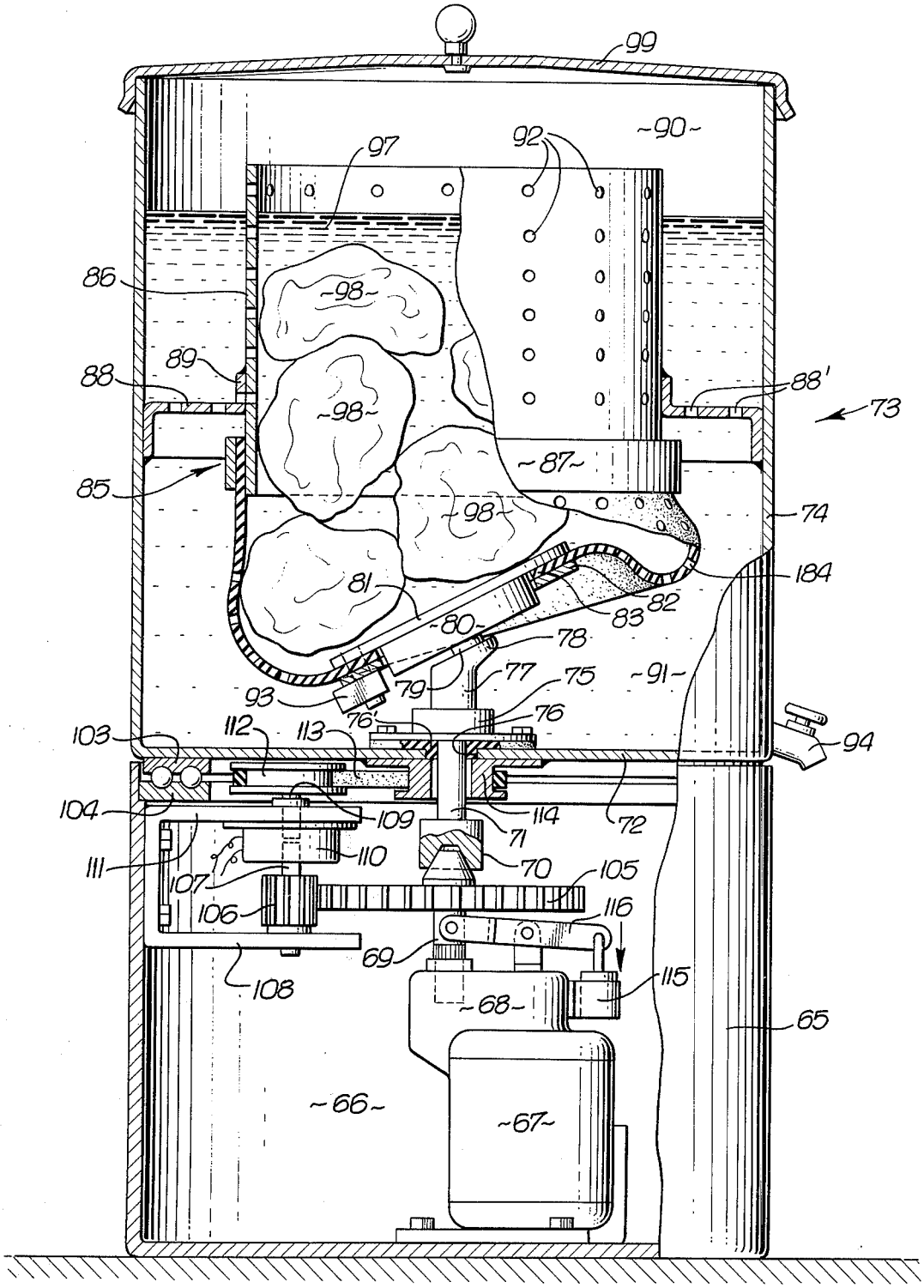
FIG. 3 is a longitudinal sectional view of another form of the device showing a liquid-like charge of material in the inner moving container preparatory to the conditioning operation.

In a second embodiment of the invention shown in FIG. 3, the frame consists of a cylindrical base 65 in which a chamber 66 houses an electric motor 67 with its gear reducer 68 arranged to drive a drive shaft 69. A conical clutch 70 when in engagement transfers the drive to a driven shaft 71 which extends through the bottom 72 of a housing indicated generally by the reference character 73 embodied in part in a cylindrical wall 74. A seal 75 attached to the bottom 72 above an opening 76 therein accommodates the driven shaft permitting it to rotate freely. At the upper end of the driven shaft is a fitting 77 having an offset head 78 on which is a tilted shaft 79 forming part of the wobble action. The tilted shaft 79 is rotatably secured in a disc 80 which is part of an inner plate 81. The inner plate 81 and an outer plate 82 hold between them an annular edge 83 of a flexible section 84, the flexible section being part of a container indicated generally by the reference character 85, of which a rigid section 86 forms the other part. The upper edge of the flexible section is anchored to the lower edge of the rigid section by means of a band 87.

For mounting the container in the housing 74 there is provided a partition 88 on which is an annular flange 89, the rigid section 86 being secured to the annular flange 89 by welding or other appropriate attachment.

In addition to providing a support for the container 85 the partition 88 divides the interior of the housing 73 into an upper chamber 90 and a lower chamber 91. The container 85 is in communication with the upper chamber 90 not only by reason of the rigid section having an open top, but also by use of the multiplicity of perforations 92 which extend through the wall of the rigid section. If desired the flexible section 84 may be provided with perforations 184 to communicate with the lower chamber 91. A solenoid actuated drain valve 93 is adapted to be opened and closed by remote control when the liquid contents of the container are to be discharged. After the liquid contents pass through the open drain valve into the lower chamber 91, they can be discharged therefrom by a discharge valve 94.

As pictured by way of example, the machine is set up for washing of bundles 98 of fabric in a detergent liquid 97. It will be appreciated, however, that this is by way of example only inasmuch as the charge could be solid objects or virtually any type or description of article which might need conditioning, as for example washing, dyeing, impregnating, bleaching, softening, etc.

A lid 99 is shown closing the top of the container 73 where an occasion might require conditioning under special designated pressure as, for example, either a vacuum or negative pressure on the one hand, or a positive pressure on the other hand. On other occasions the chamber 90 may be filled with a selected gas of some predetermined mixture.

After the charge has been conditioned, as suggested in the foregoing description, and it should become desirable to rid the bundles 98 of surplus moisture, there is an arrangement built into the housing 73 making it possible to spin dry the contents. To accomplish this an annular bearing comprising upper and lower races 103 and 104 serves to mount the housing 73 on the cylindrical base 65. A gear train consisting of a large gear 105 on the drive shaft 69 meshing with a small gear 106 on a driven shaft 107 is made use of to rotate the driven shaft 107 at a relatively higher speed. The driven shaft is journaled on a bracket 108.

A second drive shaft 109 in axial alignment with the driven shaft 107 has a magnetic clutch 110 associated therewith the second drive shaft being rotatably mounted in a bracket 111. On the second drive shaft 109 is a pulley 112 over which passes a belt 113, the belt passing over a pulley 114 on the drive shaft 71. The pulley 114 is made fast to the bottom 72 of the housing 73 so that when the pulley 114 is rotated, the housing 73 will be rotated. When the housing 73 is being rotated at the higher speed made possible by the gear ratios of the gears 105 and 106, the clutch 70 is disengaged by manipulation of the plunger 115 and rocker arm 116 in a substantially conventional fashion.

Figure 4:
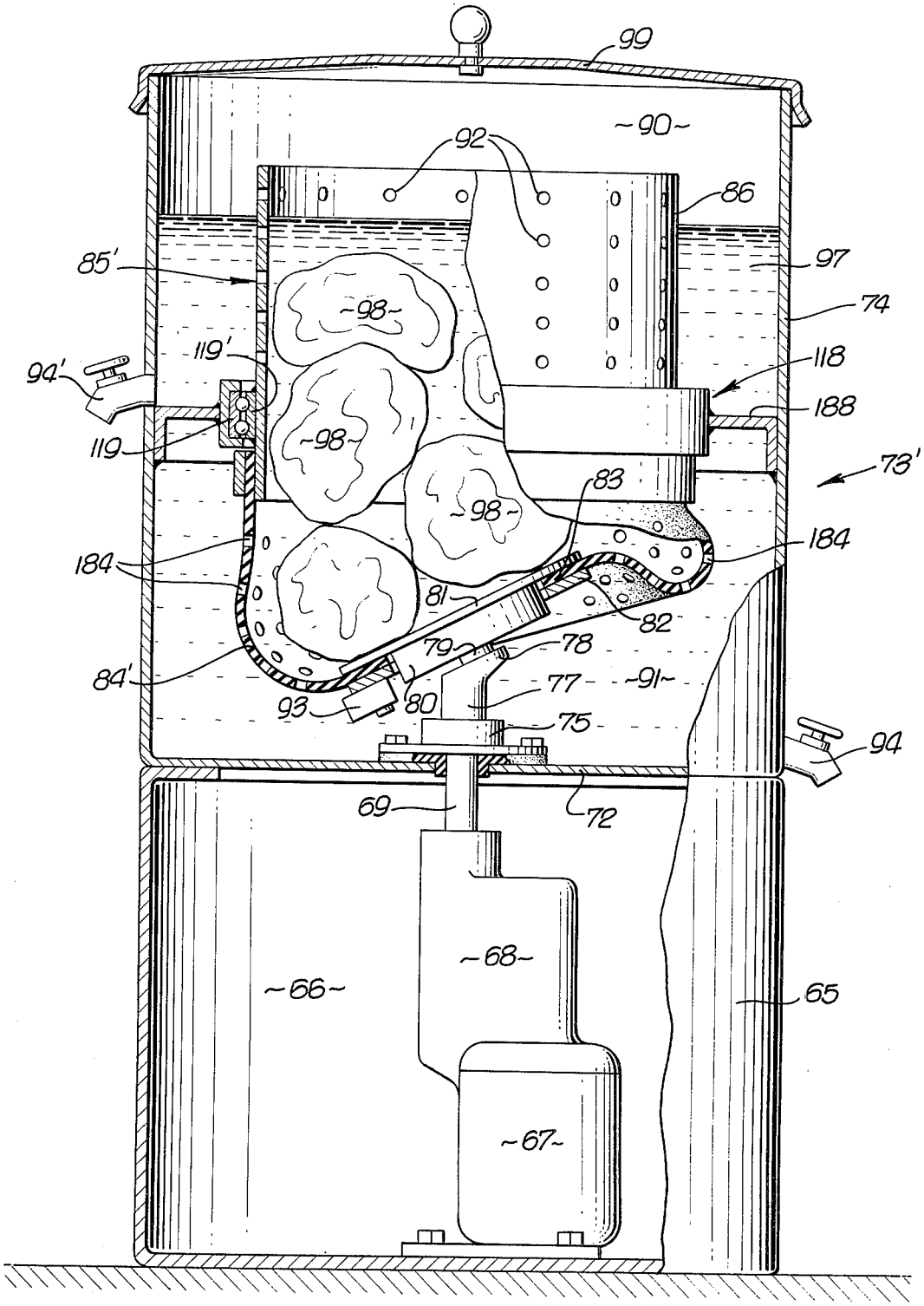
FIG. 4 is a longitudinal sectional view of a somewhat simpler version of the conditioner pictured in FIG. 3.

Holes 88' through the partition 88 allow liquid to entirely surround both upper and lower portions of the container 85. A seal 76' effectively seals the opening 76 through which the drive shaft 71 passes. In the form of invention of FIG. 4 which resembles FIG. 3 as to its general aspects, a partition 188 which carries the upper rigid section 86 of a container 85' on the cylindrical wall 74 is imperforate. Holes 184 through the lower flexible section 84' permit liquid to pass freely between the the interior of container 85' and the lower chamber 91. A housing 118 contains a fixed outer bearing ring 119 and an inner bearing ring 119' attached to the upper rigid section 86 so that if need be the container 85' is free to rotate. A discharge valve 94' drains the upper chamber 90.

Figure 5:
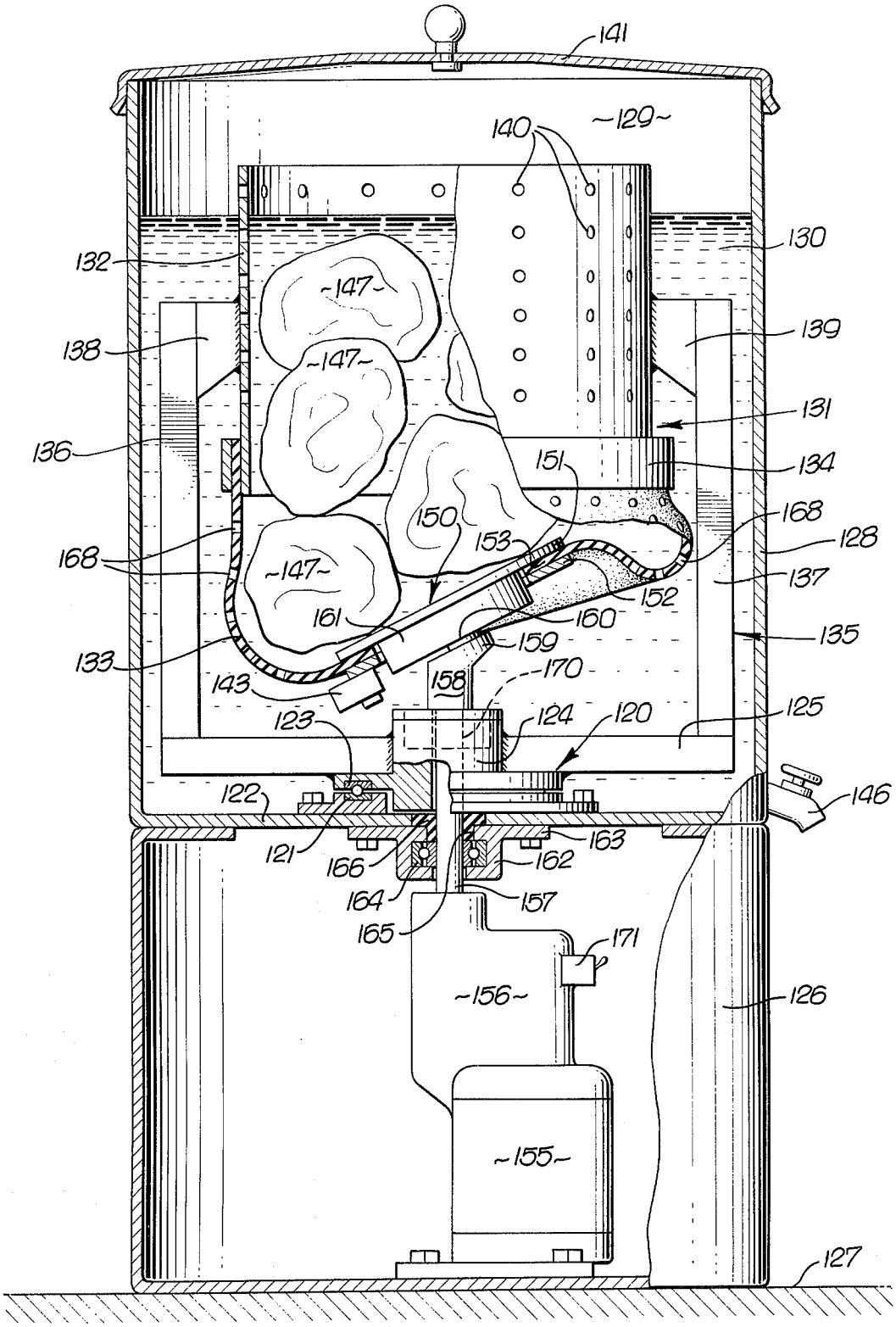
FIG. 5 is a longitudinal sectional view of still another form of the invention.

In the form of invention of FIG. 5, spin dry is accomplished in a different fashion. To make this possible an annular bearing 120 is made use of. One bearing ring 121 is mounted on a partition 122, and a second bearing ring 123 is secured to a bushing 124 anchored in a platform 125. The partition 122 is at the top of a base 126 on a supporting surface 127. More particularly the partition is the bottom of a housing 128, the housing forming a chamber 129 for a reservoir of liquid 130.

Within the chamber 129 is an agitating container indicated generally by the reference character 131. In this form of the invention the agitating container 131 has a rigid upper section 132 and a flexible lower section 133 secured to the upper section by a band 134. A rotating yoke 135, of which the platform 125 is part, has arms 136 and 137, the tops of which have plates 138 and 139 to which the upper section 132 is anchored. Perforations 140 allow the liquid 130 to pass into the container 131 and a lid 141 keeps the liquid from splashing out.

At the bottom of the lower section solenoid actuated discharge valve 143 can be opened to completely drain the container when needed. To empty the chamber 129 a drain valve 146 is provided.

For agitating the contents 147 of the container 131 while the yoke 135 remains stationary use is made of a wobble assembly 150. As in other forms of the invention the wobble assembly consists of an inner plate 151 and an outer plate 152 which clamp between them an annular edge 153 of the lower section.

Power for the operation is provided by a motor 155 in the base 126 acting through a speed reducer 156 to rotate a motor shaft 157. A fitting 158 on the shaft 157 has an offset head 159 on which is a freely rotating shaft 160 journaled in a disc 161, the disc being part of the inner plate 151.

A bearing unit 162 secured by a flange 163 to the underside of the partition 122 contains a bearing 164 which rotatably supports the shaft 157, the shaft extending through an opening 165 in which is a seal 166.

Where a spin dry action is desired there is employed a clutch 170 of substantially conventional construction mounted in the bushing 124, and, when desired, operated by electronic means (not shown) from an exterior station. Action of the clutch is to interconnect the shaft 157 and the yoke 135 so that the yoke and all that is mounted on it rotates.

In this form of the device perforations 168 may be provided in the flexible lower section 133.

The motor 155 may, for example, be a two-speed motor controlled by an appropriate motor switch 171 whereby when the device is being used for conditioning such, for example, as washing, the low speed rate is employed. When the spin dry operation is to take place, the motor can be shifted to high speed operation. Consequently, the rotation of the yoke 135 at the relatively higher speed spins the container 131 thereby to rid the bundles of presence of liquid by operation of centrifugal force. Such liquid as may be thus spun from the bundles can again the drained off through the drain valve 146.

While the invention has herein been shown and described in what is conceived to be a practical and effective embodiment, it is recognized that departures may be made therefrom within the scope of the invention, which is not to be limited to the details disclosed herein but is to be accorded the full scope of the claims so as to embrace any and all equivalent devices.

Having described the invention, what is claimed as new in support of Letters Patent is:

1. A conditioner for liquid-like charges comprising a frame, a closed housing on the frame, a composite container for said charges comprising a lower flexible section located within said housing and an upper rigid section, a wobble plate mounted on the bottom of the flexible section, a wobble drive rotatably journaled in a lower wall of said housing and having a driving relationship with said wobble plate, a motor on said frame at a location below said housing, said motor having a driving connection with the wobble drive whereby to impart an oscillatory motion to the flexible section and liquid-like charge therein, both the lower flexible section and the upper rigid section being within the housing and a partition separating the interior of the housing into a lower chamber surrounding the flexible section and an upper chamber surrounding the rigid section.

2. A conditioner for liquid-like charges as in claim 1 wherein there is a drain valve at the bottom of the flexible section and a drain valve at the bottom of said chamber.

3. A conditioner for liquid-like charges as in claim 1 wherein there is a releasable clutch in said driving connection, said housing having a rotatable mounting on the frame and a selective high-speed drive between said motor and the housing whereby to spin dry the liquid-like charge.

4. A conditioner for liquid-like charges as in claim 1 wherein the rigid section has openings through the wall thereof whereby to provide communication between the rigid section and the upper chamber.

5. A conditioner for liquid-like charges comprising a frame, a closed housing on the frame, said housing having lower, side and top wall structures and a removable closure on one of said structures, a composite container for said charges comprising a lower flexible section located within said housing and an upper rigid section, a wobble plate mounted on the bottom of the flexible section, a wobble drive rotatably journaled in a lower wall structure of said housing and having a driving relationship with said wobble plate, a motor on said frame at a location below and exterior relative to said housing, said motor having a driving connection with the wobble drive whereby to impart an oscillatory motion to the flexible section and liquid-like charge therein, said housing surrounding both the flexible section and the rigid section and a partition separating the interior of the housing into a lower chamber surrounding the flexible section and an upper chamber surrounding the rigid section, both said sections having openings through the respective walls, and means for draining said container.

6. A conditioner for liquid-like charges as in claim 5 wherein the container is rotatably mounted within said housing, means for un-locking the wobble motion whereby to provide a rotating drive from said motor to said container for the centrifugal expulsion of moisture from said container.

7. A conditioner for liquid-like charges as in claim 6 wherein said motor is a two-speed motor.

8. A conditioner for liquid-like charges as in claim 6 wherein said motor is a variable speed motor.

9. A conditioner for liquid-like charges comprising a frame, a closed housing on the frame, said housing having lower, side and top wall structures and a removable closure on one of said structures, a composite container for said charges comprising a lower flexible section located within said housing and an upper rigid section, a wobble plate mounted on the bottom of the flexible section, a wobble drive rotatably journaled in a lower wall structure of said housing and having a driving relationship with said wobble plate, a motor on said frame at a location below and exterior relative to said housing, said motor having a driving connection with the wobble drive whereby to impart an oscillatory motion to the flexible section and liquid-like charge therein, a motor driven shaft from the motor to the wobble drive, a yoke rotatably mounted on said drive shaft and rotatably supported on said frame, and a clutch having one clutch element engagable with the drive shaft and another clutch element engageable with the yoke whereby to interconnect the yoke with the drive shaft for rotating the yoke together with the container.

* * * * *